US008196752B2

(12) United States Patent
Wark

(10) Patent No.: US 8,196,752 B2
(45) Date of Patent: Jun. 12, 2012

(54) SELF-CLEANING COAL SEPARATOR GRIDS WITH MULTIPLE CLEANING COMBS

(76) Inventor: Rickey E. Wark, Spring, TX (US)

( * ) Notice: Subject to any disclaimer, the term of this patent is extended or adjusted under 35 U.S.C. 154(b) by 0 days.

(21) Appl. No.: 13/075,220

(22) Filed: Mar. 30, 2011

(65) Prior Publication Data

US 2011/0186667 A1 Aug. 4, 2011

Related U.S. Application Data

(62) Division of application No. 12/243,019, filed on Oct. 1, 2008.

(51) Int. Cl.
*B07B 1/52* (2006.01)

(52) U.S. Cl. ..... 209/387; 209/627; 209/384; 241/81

(58) Field of Classification Search ..... 209/384, 209/387, 393, 627, 659, 660
See application file for complete search history.

(56) References Cited

U.S. PATENT DOCUMENTS

| | | | | | |
|---|---|---|---|---|---|
| 3,074,655 | A | * | 1/1963 | Gontier | 241/88.4 |
| 3,429,445 | A | * | 2/1969 | Lee | 210/357 |
| 4,244,530 | A | * | 1/1981 | Halvorsen | 241/21 |
| 4,592,516 | A | * | 6/1986 | Tschantz | 241/76 |
| 4,966,689 | A | * | 10/1990 | Wark et al. | 209/384 |
| 5,133,852 | A | * | 7/1992 | Wark | 209/389 |
| 5,310,065 | A | * | 5/1994 | Wark | 209/627 |
| 5,673,862 | A | * | 10/1997 | Wingler | 241/81 |

* cited by examiner

*Primary Examiner* — Terrell Matthews
(74) *Attorney, Agent, or Firm* — Young Basile Hanlon & MacFarlane PC

(57) ABSTRACT

A lump coal size sorting grate comprising parallel bars is provided with three spaced apart, parallel cleaning combs which can be individually activated to clean the sizing grid of lodged coal lumps in a predetermined sequence so that the entire sizing grid is never closed during a coal sorting operation. The cleaning combs are made of spaced, parallel bars which can be pivoted upwardly, between and through the bars of the sizing grate. An adaptive system which senses and responds to a clogged condition in the grate can be provided by sensing crusher motor current or, in the alternative, sensing grate bar deflection using strain gage transducers.

3 Claims, 4 Drawing Sheets

SELF-CLEANING COAL SEPARATOR GRIDS WITH MULTIPLE CLEANING COMBS

FIELD OF THE INVENTION

This invention relates to the sorting of lump coal according to size so that coal above a certain size is directed to a crusher while coal below said certain size is directed to a conveyor, and more particularly to an assembly having a sizing grate and two or more independently actuable cleaning combs, each cleaning comb being effective to remove jammed coal from a respective portion of the overall area of the sizing grate.

BACKGROUND OF THE INVENTION

U.S. Pat. No. 4,966,689 issued Oct. 30, 1992 issued to R. Wark et al. describes a self-cleaning grate assembly which is used as a size-based sorting device for lump coal. The device segregates coal according to size so that oversize coal lumps can be directed to a crusher for further size reduction. Devices of this type are used in systems for supplying pulverized coal to a combustion chamber in an electrical utility plant.

Because lump coal tends to get jammed between the bars of the sizing grate, it has been found desirable or necessary to clean the grate from time to time. This is accomplished by passing the bars of a pivotally displaceable cleaning comb upwardly through and between the spaced bars of the sizing grate so as to dislodge jammed lumps and send them in the direction of the crusher. The '689 patent, the disclosure of which is incorporated herein by reference, discloses such a cleaning comb, and an actuator for causing periodic operation of the cleaning comb.

SUMMARY OF THE INVENTION

The present invention eliminates a disadvantage of the prior art '689 patent which arises out of the fact that while the cleaning comb is passing through the sizing grate, the grate is momentarily blocked and directs all coal to the crusher regardless of size. To remedy this disadvantage, I provide a fixed sizing grate and a plurality of cleaning combs, each of which can be activated independently of the others. In this fashion, the fixed grate can be systematically cleaned without ever being completely blocked.

In the preferred embodiment of my invention, the fixed grate is divided up into three parallel areas of approximately equal size, each of which is equipped with its own, individually actuable cleaning comb. The fixed grate is mounted at an angle and the cleaning combs hand down behind it. I use hydraulic or pneumatic actuators to swing the cleaning combs upwardly through the bars of the fixed grate one or two at a time, but not all at once when coal is being directed onto and through the grate. Therefore, the grate is never completely closed when in normal operation.

In according with a still further aspect of my invention, I provide a control system which can be one of several types or can use a combination of the features hereinafter described. In the simplest form, the control system may involve the use of a clock or timer which activates the individual cleaning combs in a sequential fashion such as one, two, three, or one, three, two or one, three, one, three, two, where "one" and "three" designate the two outside grate areas and two represents the middle area. Of course, the use of three grate subareas is illustrative only and either a lesser number or a greater number of subareas with individual cleaning combs and actuators may be used.

In accordance with a still further aspect of my invention, the control system may have an adaptive quality; i.e., it may be structured in such a way as to respond to an indication of a clogged condition, to bring the cleaning combs into operation. One such adaptive system uses a current monitor associated with the crusher motor to actuate the cleaning combs when crusher motor current rises above a predetermined threshold level. I have found that such a rise in motor current is associated with a clogged grate which is causing excess coal to be directed to the crusher.

Another adaptive system uses load cell transducers mounted on or in the fixed grate bars to sense deflection due to a buildup of coal on the bars, which again is associated with a clogged condition. Combinations of these adaptive systems can also be used as well as combinations of one or more adaptive features with a simple clock-based timer.

Other applications of the present invention will become apparent to those skilled in the art when the following description of the best mode contemplated for practicing the invention is read in conjunction with the accompanying drawings.

BRIEF SUMMARY OF THE DRAWINGS

The description herein makes reference to the accompanying drawings wherein like reference numerals refer to like parts throughout the several views and wherein.

DETAILED DESCRIPTION OF THE ILLUSTRATIVE EMBODIMENT

Figure 1:
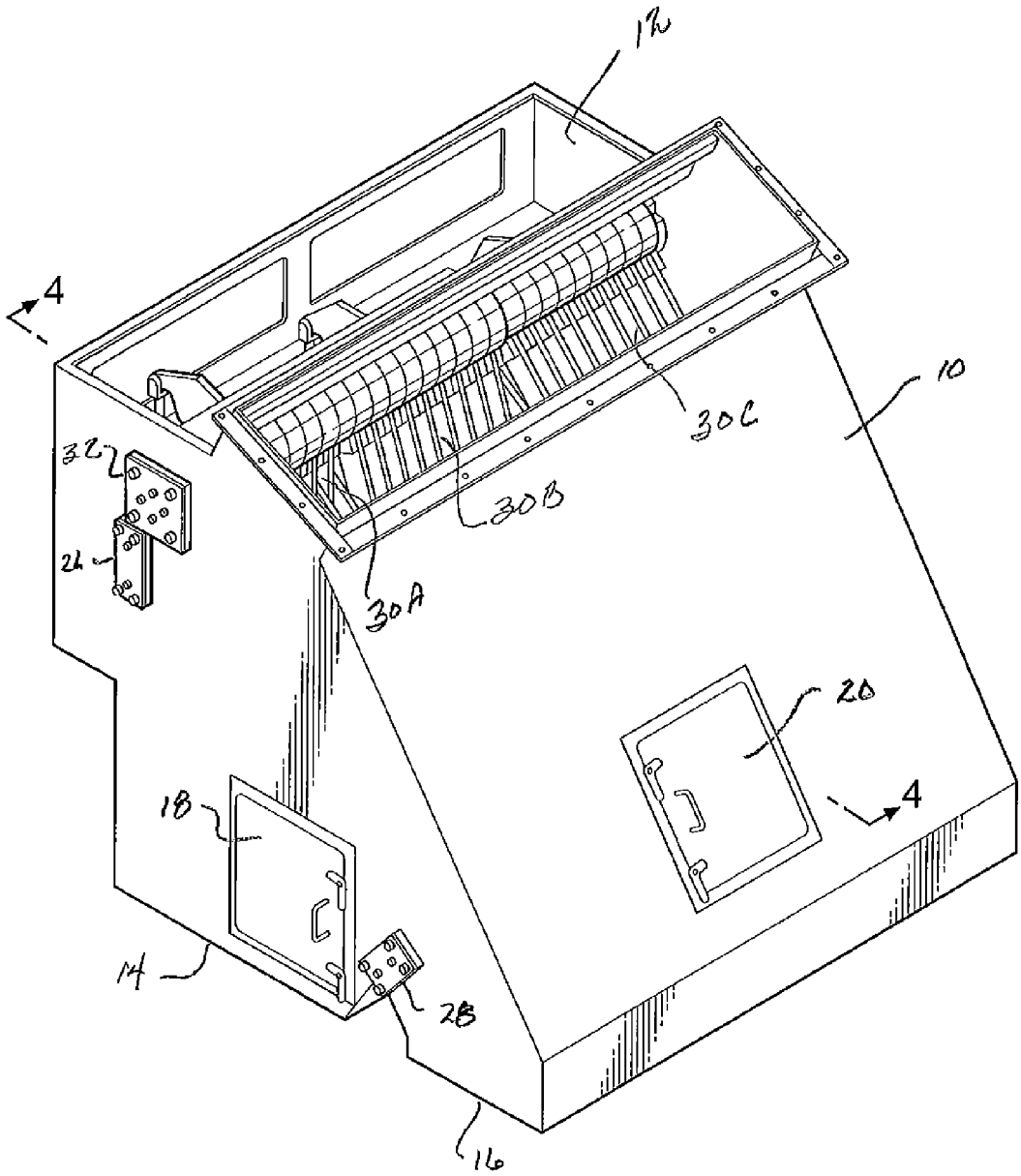
FIG. 1 is a perspective view of an embodiment of my invention using three parallel cleaning combs in association with a lump coal sizing grate in a housing having a top-located input and two bottom-located outputs.

Referring now to FIGS. 1 through 4, the illustrative embodiment of the invention comprises a fabricated metal housing 10 having a top input 12 for the entry of lump coal and bottom outlets 14, 16 which represent discharge chutes for size-sorted coal. As is more fully described in the '689 patent, the outlet 16 is typically routed to a crusher because it represents the outlet for coal which is above a predetermined lump size. Outlet 14 leads to a conveyor. The housing 10 is provided with hinged access doors 18, 20 in conventional fashion.

Mounted within the housing 10 between the inlet 12 and the outlets 14, 16 is a fixed sizing grate 22 consisting of a plurality of spaced apart, hardened metal bars mounted in parallel and at an inclined angle to receive lump coal from the inlet 12. The spacing between the bars 24 is such as to provide a sizing function wherein oversize lumps of coal are deflected to the outlet 16 which leads to the crusher, whereas smaller sized lumps are allowed to pass through and between the bars 24 to the conveyor outlet 14.

Figure 2:
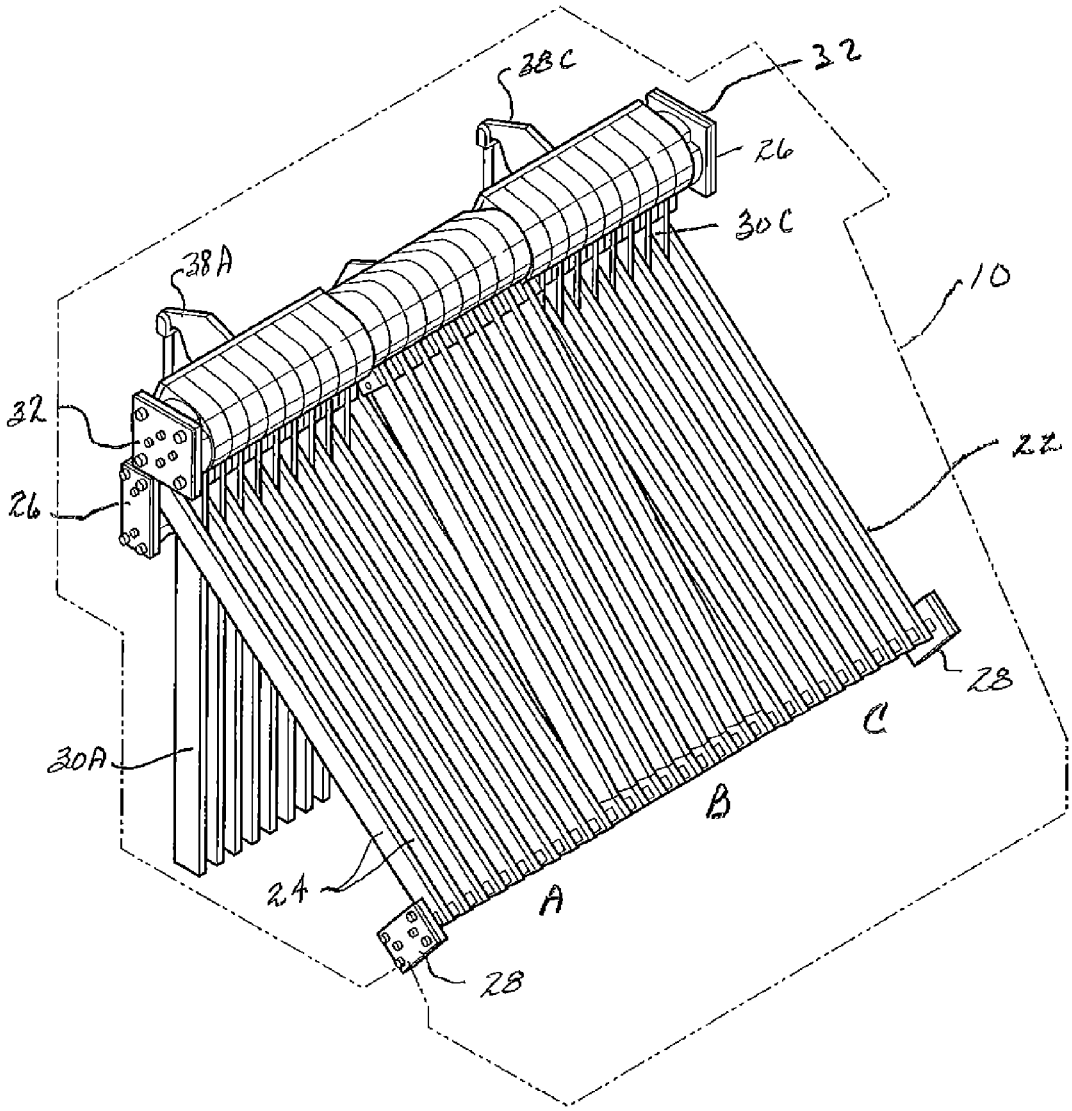
FIG. 2 is a perspective view of the sizing grid and the three parallel cleaning combs disposed within the housing of the device of FIG. 1.

In accordance with the invention, the overall area of the sizing grate 22 is divided into three relatively equal subareas A, B, C, as is best represented in FIG. 2. As stated above, the number of subareas can be two or more, but I have found that three is a practical division of the grate area for the functions I intend to provide through this invention. The bars 24 of the grate 22 are mounted between sets of plates 26, 28 which are located on the outside surfaces of the housing 10 as shown in FIG. 1.

In accordance with the invention, three parallel cleaning combs 30A, 30B and 30C are provided. The cleaning combs 30 are pivotally mounted within the housing 10 on a common shaft 31 which is secured by plates 32. Each cleaning comb 30A, 30B and 30C comprises a set of spaced apart, parallel hardened metal bars which are sized so as to be capable of passing upwardly through and between the sizing bars 24 of the fixed grate 22 as they are rotated about the center axis of the shaft 31. In the inactive or home positions, the cleaning combs 30 simply hand straight down behind the sizing grate 22 where they do not interfere with any coal flow.

Selective rotation of the individuals cleaning combs 30A, 30B and 30C is provided by actuators 34A, 34B and 34C which are preferably hydraulic cylinders but may be, electric, pneumatic or combination air-oil devices as well. The actuator cylinders 34 are connected to crank arms 38A, 38B and 38C which in turn, are connected to manifold plates 36A, 36B and 36C to which the comb bars are secured in spaced apart, parallel groups. In essence, this arrangement provides three grate-type cleaning combs, each associated with an individual area A, B and C of the fixed sizing grate 22 and, as hereinafter described, each being capable of individual actuation such that the entirety of the effective surface area of the sizing grate 22 is never completely closed during an operation in which lump coal is directed through the inlet 12. Of course, the combs may be simultaneously actuated for exercise or testing purposes.

Figure 3:
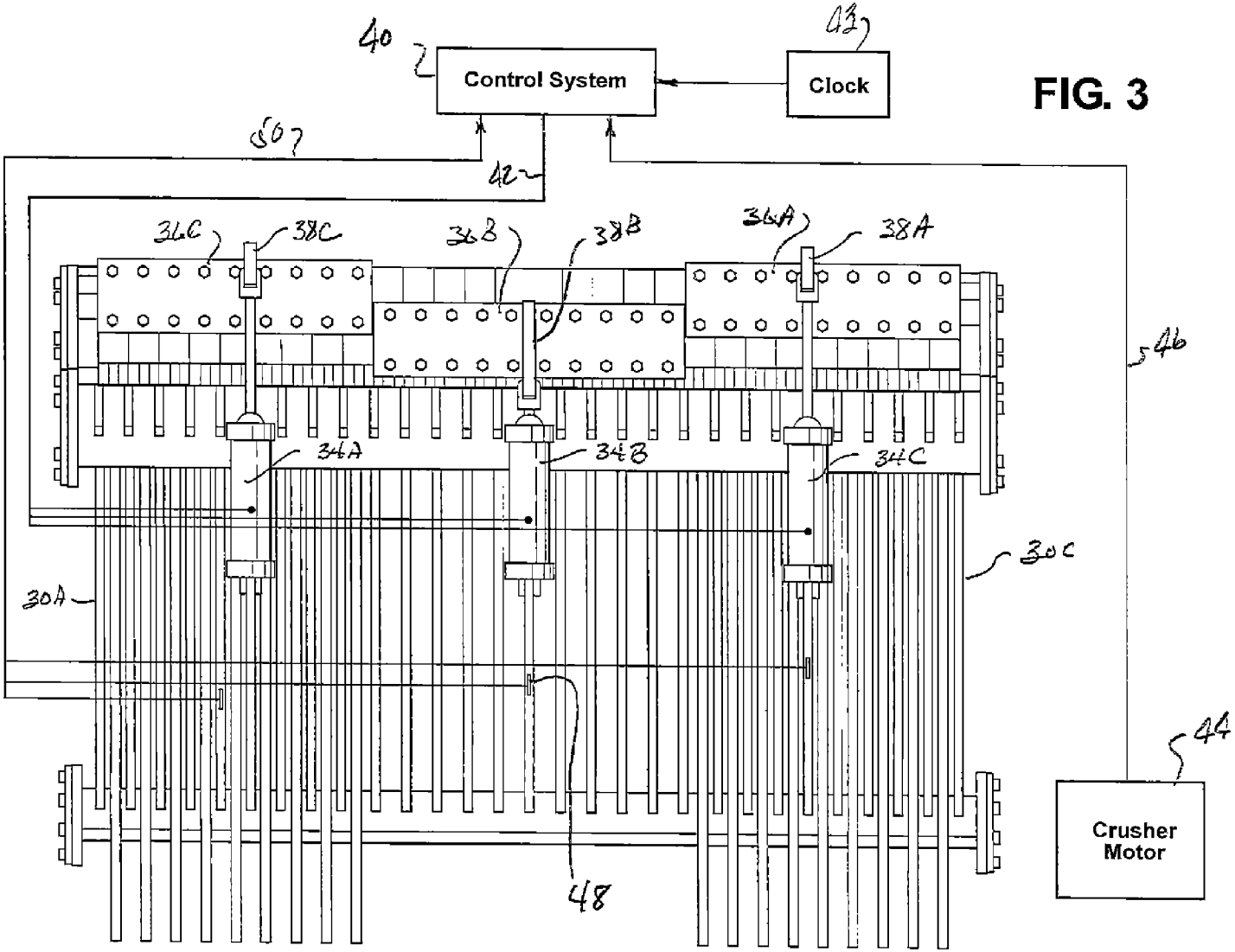
FIG. 3 is a rear view of the sizing grid and cleaning combs showing a combination of control systems having the adaptive features described above.
Figure 4:
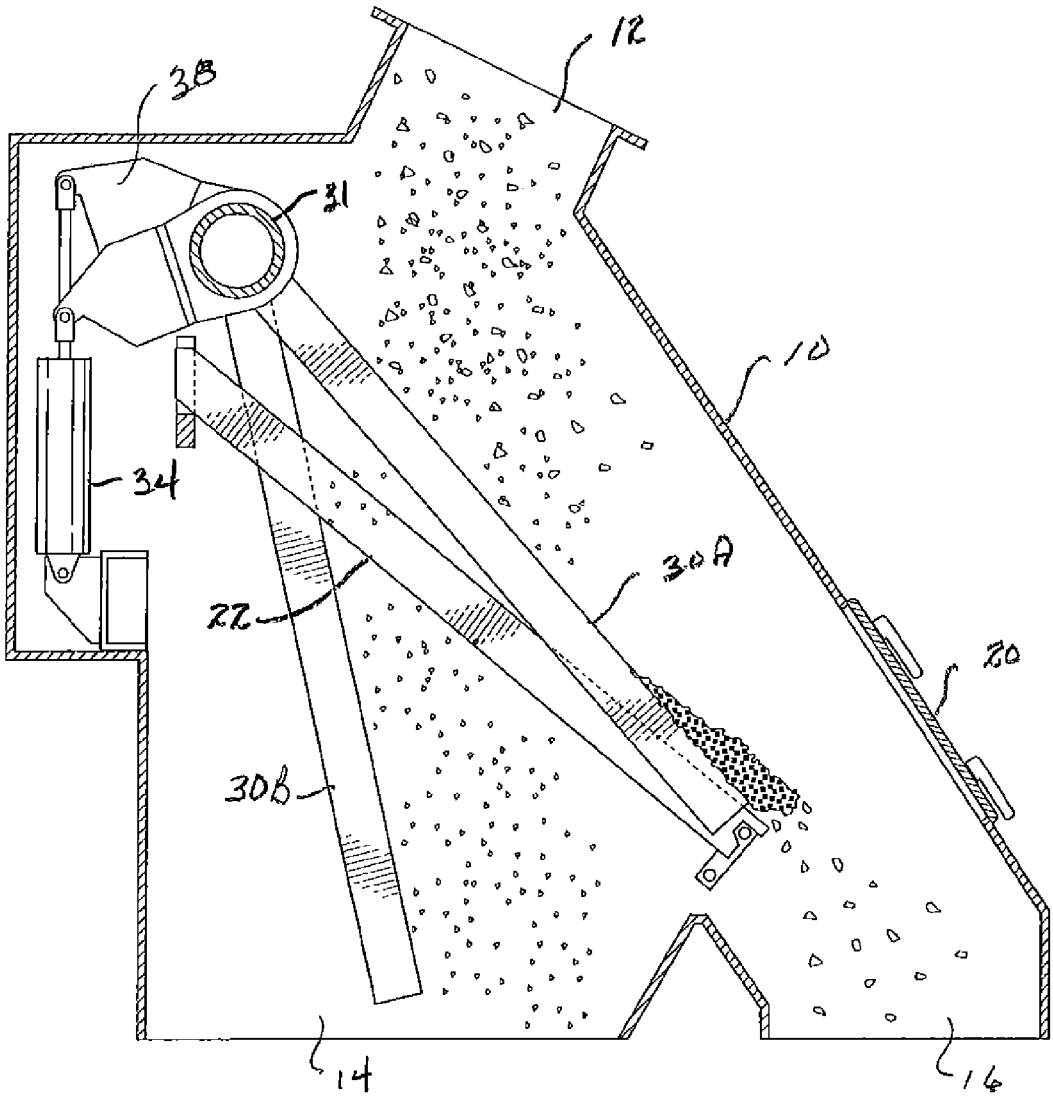
FIG. 4 is a side view of the embodiment of FIG. 1.

Referring now to FIG. 3, the sizing assembly further comprises a control system 40 which is preferably of the modern, digital semiconductor/microprocessor type, connected by cable 42 to the individual actuator cylinders 34A, 34B and 34C to selectively cause activation thereof. It will be understood that each of the cylinders is connected to its own hydraulic fluid source and pump and these details have been omitted from the drawing of FIG. 3 since they are conventional and known to persons skilled in the art. A suitable electromechanical device such as a solenoid controlled valve receives the signals on cable 42 on control system 40 as will be apparent to those of ordinary skill in the hydraulic or pneumatic arts.

As shown in FIG. 3, the control system 40 may receive input signals from a clock or timer 43. In the simplest form, the control system responds to clock counts to activate the actuators 34A, 34B and 34C in an appropriate sequence on a periodic basis during operation of the system. Alternatively, the system may operate in an adaptive fashion wherein it responds to specific sensed conditions associated with the sizing grate 22. One such adaptive system comprises a current sensor 44 associated with the crusher motor to sense a rise in electrical current drawn by the crusher motor during a sizing operation. When the motor current exceeds a predetermined level which is determined empirically, a signal is sent via line 46 to the control system 40 to signal the control system that too much coal is being diverted to the crusher. This is interpreted as a clogged condition in the sizing grate 22 and the hydraulic actuators 34A, 34B and 34C will again be operated in a preselected sequence. The sequence is not necessarily linear, i.e., A, B, C, but may involve non-linear sequences that are empirically proven to be effective for any particular grate.

FIG. 3 also illustrates another adaptive system in which load cell transducers are mounted on or in the bars 24 and the grate 22 in each of the sizing areas A, B and C to sense a buildup of coal on the grate due to a clogged condition. Because the throughput is extremely high, the coal buildup occurs extremely quickly and causes sufficient deflection of the hardened steel bars of the grate 22 to produce a usable, electrical signal from the load cells from one or more of the load cells 48. These signals are conveyed by way of the three wire cable 50 to the control system 40 where they trigger the activation of the actuators 34A, 34B and 34C in a preselected sequence. The two adaptive systems shown in FIG. 3 will not normally be used together as one or the other will accomplish the desired result. However, either one may be used with a simple periodic clock-based system as shown.

As will be apparent from the foregoing, activation of one of the actuators 34 causes the cleaning comb bars to swing upwardly through and between the bars 24 of the grate 22, thus dislodging coal which has become stuck between the bars and which partially closes the grate and contributes to an eventual of coal thereon. Limit switches or the like, as explained in the '689 patent may be used to trigger a reversal of the actuators 34 to pull the comb bars back into the lowered out-of-service position shown in FIG. 2, or they may be allowed to fall under the force of gravity since at this point there will be nothing to obstruct the return of the comb bars to the parked position shown in FIG. 2.

In this fashion, the sizing grid 22 is always at least partially operative even if two of the cleaning combs is activated at or essentially the same time. The life of the crusher is prolonged and the quantity of electricity consumed by the crusher motor is reduced.

It is to be understood that the particular geometry of the sizing grate and the cleaning combs is not limited to the purely linear design shown in these drawings, but may take any of several other forms that are found by persons skilled in the art to be effective and/or to fit in any particular application.

What is claimed is:

1. A system for handling lump coal comprising:

an electric motor which draws current for operating a crusher;

a sizing grate for receiving lump coal; said grate comprising parallel bars spaced apart to pass coal less than a predetermined size to a utilization area and divert coal greater than the predetermined size to the crusher;

selectively operable cleaning means for clearing jammed coal from the sizing grate; and adaptive control means for monitoring current drawn by the electric motor and operating said cleaning means when the current drawn from operating the crusher exceeds a predetermined value.

2. The system described in claim 1 wherein said cleaning means comprises at least one pivotally mounted cleaning comb made up of parallel bars spaced apart to fit between the grate bars, and an actuator for pivoting said comb through a reciprocal cleaning stroke.

3. The system described in claim 1 wherein said cleaning means comprises at least two pivotally mounted cleaning combs in side-by-side relation and made up of parallel which fit between the sizing grate bars, each comb having an actuator for pivoting an associated comb through a reciprocal clearing stroke, wherein said control means operates to activate said actuators in sequence.

* * * * *